United States Patent [19]

Wiemer

[11] 4,127,381

[45] Nov. 28, 1978

[54] APPARATUS FOR COMPENSATING FOR CHANGE IN THE LENGTH OF THE PALLET TRAIN OF A STRAND SINTERING MACHINE

[75] Inventor: Erich Wiemer, Essen, Fed. Rep. of Germany

[73] Assignee: Koppers Company, Inc., Pittsburgh, Pa.

[21] Appl. No.: 805,285

[22] Filed: Jun. 10, 1977

[30] Foreign Application Priority Data

Jun. 18, 1976 [DE] Fed. Rep. of Germany ..... 2627234

[51] Int. Cl.[2] ..... F27D 3/00; C21B 1/18

[52] U.S. Cl. ..... 432/245; 266/180

[58] Field of Search ..... 432/245; 266/178, 183, 266/180

[56] References Cited

U.S. PATENT DOCUMENTS

| | | | |
|---|---|---|---|
| 3,329,419 | 7/1967 | Corson | 266/183 |
| 3,733,173 | 5/1973 | Csapo et al. | 432/245 |

*Primary Examiner*—John J. Camby

*Attorney, Agent, or Firm*—R. Lawrence Sahr; Oscar B. Brumback

[57] ABSTRACT

In a strand sintering machine, an arrangement and position of drive lifting sprockets, operable in conjunction with two pairs of pallet alignment gears, is disclosed. The drive lifting sprockets are positioned at the feed end of the strand tracks. Two pairs of gears, operable by a common chain drive, are positioned near the discharge end of the strand sintering machine adjacent to the pallet return tracks. The gears coact with the tooth pockets in the pallets to align those pallets with the return tracks and to separate the pallets thus relieving the pressure of pallet accumulation upon the drive lifting sprockets.

3 Claims, 1 Drawing Figure

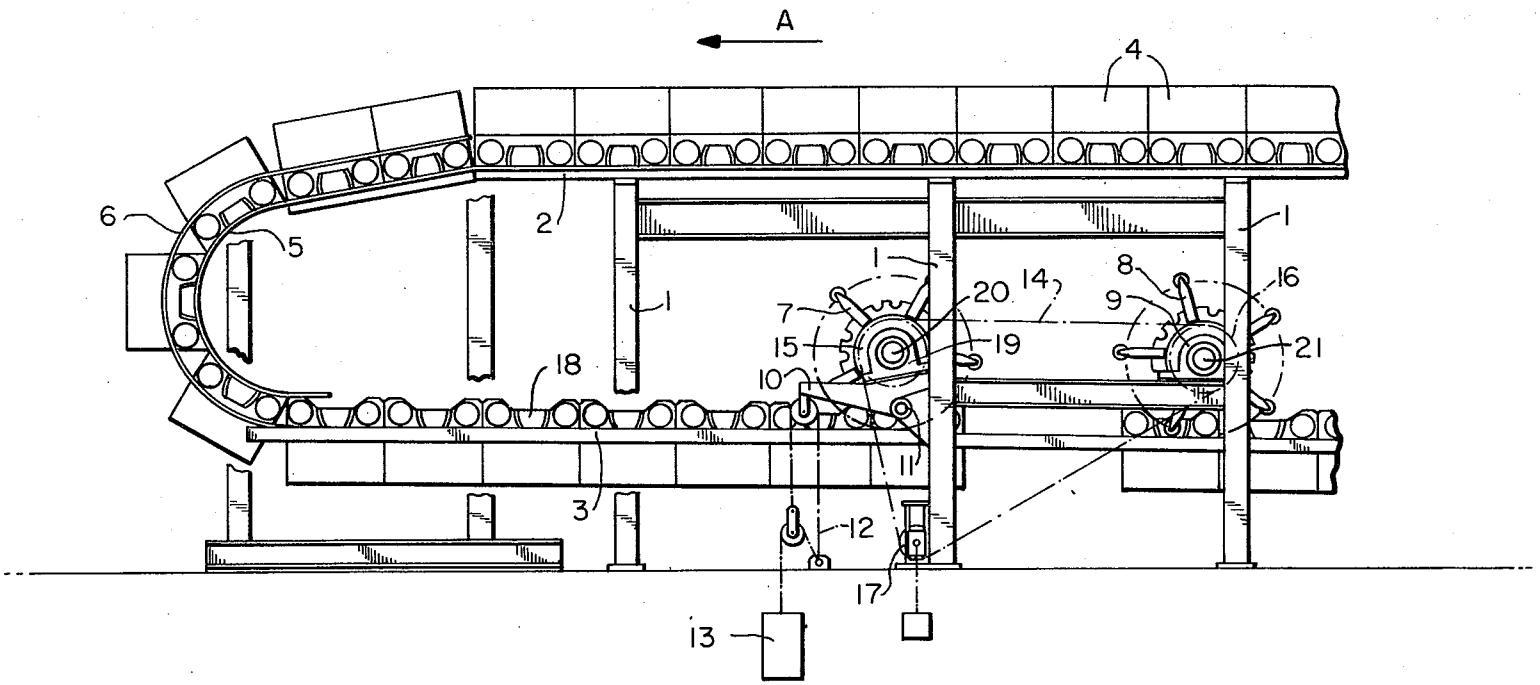
A
1
2
3
4
5
6
7
8
9
10
11
12
13
14
15
16
17
18
19
20
21

APPARATUS FOR COMPENSATING FOR CHANGE IN THE LENGTH OF THE PALLET TRAIN OF A STRAND SINTERING MACHINE

BACKGROUND OF THE INVENTION

1. Field of the Invention

This invention relates to improvements in strand sintering machinery and, in particular, to the drive and alignment apparatus for the pallets and pallet train thereon.

2. Description of the Prior Art

Strand sintering machinery includes an upper trackway made up of parallel rails on which sinter pallets ride. Each pallet is similar to a small cart, usually with four wheels, upon which sinter material reposes and is cooled. The pallet wheels ride on the upper trackway, after receipt of the sintering material, and pass over means for passing cooling air through the sinter material thereon and move toward the discharge end of the machine. At the discharge end of the machine, the pallets move down a sloped section of the parallel rails where the sinter material is emptied by gravity at the apex of an arcuate section of the trackway. The pallets then move, by gravity, further downward and onto a lower trackway. The pallets, at this point, are inverted from their original position on the upper trackway. The inverted pallets, each being pushed in succession by the next pallet in line, move as a pallet train toward the feed end of the machine. At the feed end of the machine a set of gear toothed sprockets engage corresponding gear tooth pockets in each pallet and lift it around a second arcuate section of trackway and drive it forward onto the upper trackway causing it to push its predecessor pallet along the upper trackway in the form of a pallet train.

A major problem inherent in the prior art strand sintering machines is an inability to maintain the pallets in a position parallel to the trackways during the course of the pallets' movements. Several causes have been identified as the source of this problem. One is the fact that the heat that radiates from the sinter material tends to cause movement of the rails. A second is that excess sinter material falls onto the rails causing the pallets to skew. The result of constant misalignment of the pallets with the trackways is excess wear on the pallet wheels and their bearing. The excess wear causes further skewing of the pallets which compounds the problems, resulting in frequent breakdowns and excess maintenance costs.

The gear toothed sprockets tend to realign pallets which are misaligned, but this process causes excess wear on the gear teeth and on the gear tooth pockets of the pallet.

A second problem inherent in prior art strand sintering machines is the tendency of the pallets to stack up or become jammed on the lower trackway preceding the position of the gear toothed sprockets. This causes inordinate pressure on the sprockets resulting in early wear and failure.

SUMMARY OF THE INVENTION

The current invention provides both a means for relieving the pressure on the gear toothed sprockets and for realigning the pallets at the discharge end of the strand sintering machine opposite from the end where the gear toothed sprockets are located. Two pairs of gears are located adjacent to the lower trackway in proximity to the discharge end of the strand sintering machine. One pair of gears is mounted so as to pivot axially while the other pair of gears is mounted in a stationary position. The gears are synchronously driven by power transmission means. As a pallet descends the arcuate section of trackway at the discharge end of the machine, the first pair of gears engages the gear tooth pockets in the pallet. Because this pair of gears is axially pivotal it can compensate for misalignment of the pallet and for force stresses created by the train of pallets following the subject pallet. The subject pallet is fed, by the rotation of the first pair of gears, to the second pair of gears at a set rate predetermined by the power transmission means. The second pair of gears engages the already aligned subject pallet and feeds it at a rate which is uniform and synchronized to the rate at which the gear toothed sprockets, at the feed end of the machine, lifts and drives the pallets. Between the second pair of gears and the gear toothed sprockets is a section of lower trackway upon which moves a uniformly aligned train of pallets at a predetermined constant velocity.

BRIEF DESCRIPTION OF THE DRAWING

The sole FIGURE is a schematic side view of the discharge end of a strand sintering machine illustrating the preferred embodiment of the present invention.

DESCRIPTION OF THE PREFERRED EMBODIMENT

Referring to the drawing, there is illustrated a supporting frame 1 which supports an upper trackway 2 and a lower trackway 3 upon which ride a plurality of pallets 4. The upper trackway 2 and the lower trackway 3 are connected by an inner arcuate trackway 5 and an outer arcuate trackway 6. The pallets 4 move in a direction A from the upper trackway 2 through the arcuate trackways 5 and 6 to the lower trackway 3. The pallets 4 form a train with each being pushed by the one following it. Because of the tendency of the pallets 4 to skew, the length of the pellet train per given number of pallets cha..ges unpredictably, especially on the lower trackway 3 near the arcuate trackways 5 and 6.

The present invention provides means for realigning the pallets 4 proximate to the arcuate trackways 5 and 6 and feeding those pallets 4 at a uniform rate along the balance of the lower trackway 3. A first pair of gears 7 is fixed to a shaft 20 which is rotatably mounted in a pair of bearings 19. The bearings 19 are mounted on pivotal rocker arms 10. The rocker arms 10 are pivotally mounted to journals 11 which are fixed to the supporting frame 1.

A second pair of gears 8 is fixed to shaft 21 which is rotatably mounted in a pair of bearings 9. The bearings 9 are fixed to the supporting frame 1 at a position downstream along the lower trackway 3 from the position of the first pair of gears 7.

Because the first pair of gears 7 is pivotally mounted, the distance between the centers of the two shafts 20 and 21 is changeable.

The gear pairs 7 and 8 have teeth which mesh with gear tooth pockets 18 in the pallets 4. The pivotal movement of the first gear pair 7 allows the teeth to swing the pallets 4 into alignment as those teeth engage and enter into the gear tooth pockets. The force required to so align the pallets is provided by counterweights 13 acting on the rocker arms 10 through a cable and pulley system 12.

The gear pairs 7 and 8 are connected by roller link chains 14 which run over pairs of chain sprockets 15 and 16. Chain sprocket pair 15 is fixed to shaft 20 and chain sprocket pair 16 is fixed to shaft 21. The purpose of the link chains 4 is to synchronize the rotational velocity of the gear pairs 7 and 8 and to synchronize their rotation, i.e., the positions of the teeth of the respective gear pairs 7 and 8 are synchronized with each other at all times. Tension on the chairs is maintained by chain length compensation means 17. Thus, when a pallet is pushed into and aligned by gear pair 7, gear pair 8 drives a pallet at a pre-set rate in spacing further along the lower trackway 3. In this manner a uniform rate of progression of the pallet train, on the lower trackway 3, is maintained as well as a uniform length on the pallet train per given number of pallets.

The distance separating the gear pairs 7 and 8 provide a gap in the pallet train which eliminates the pressure buildup, caused by jamming and skewed pallets, and which allows gear pair 8 to provide a uniform length in the pallet train per given number of pallets.

According to the provisions of the patent statute, the principle, preferred construction and mode of operation of the present invention have been explained and what is now considered to be its best embodiment has been illustrated and described. However, it is to be understood that, within the scope of the appended claims, the invention may be practiced otherwise than as specifically illustrated and described.

What is claimed is:

1. Apparatus for compensating for the change in length of the pallet train in a strand sintering machine and for aligning pallets thereon, said strand sintering machine which includes a parallel rail system formed into an upper trackway and a lower trackway, joined by two arcuate sections of trackway, pallets having gear pockets therein, and a set of gear toothed sprockets arranged adjacent to one of said arcuate sections of trackway for motivating said pallets around said trackway, the other arcuate section of trackway being the discharge end, comprising:

(a) a first pair of gears positioned above the lower trackway of and adjacent to the discharge end of said strand sintering machine;

(b) a first shaft to which said first pair of gears is fixed to form a common axis of rotation for said first pair of gears;

(c) a first pair of bearings within which is rotatably mounted said first shaft;

(d) rocker means upon which said first pair of bearings is mounted, adapted to pivot said first pair of bearings;

(e) pivotal journal means, fixed to the support frame of said strand sintering machine, to which said rocker means is pivotally mounted;

(f) a plurality of first gear teeth; equally arranged in aligned pairs about said first pair of gears, positioned to engage the gear pockets of said pallets of said strand sintering machine;

(g) force means acting upon said rocker means causing said gear teeth to align said pallets upon said lower trackway of said strand sintering machine;

(h) a second pair of gears, located downstream from said first pair of gears;

(i) a second shaft to which said first pair of gears is fixed to form a common axis of rotation of said second pair of gears;

(j) a second pair of bearings, fixed to said support frame of said strand sintering machine, within which is rotatably mounted, said second shaft;

(k) a plurality of second gear teeth, equally arranged in aligned pairs about said second pair of gears, positioned to engage said gear pockets of said pallets of said strand sintering machine; and (l) means for transmitting power which synchronizes the rotation of said first pair of gears with said second pair of gears.

2. The invention described in claim 1 wherein said means for transmitting power comprises:

(a) a first pair of roller chain sprockets axially fixed to said first shaft;

(b) a second pair of roller chain sprockets axially fixed to said second shaft;

(c) a pair of roller link chains correspondingly engaging said first pair of roller chain sprockets and said second pair of roller chain sprockets; and (d) means for tensioning said chain as said first shaft is pivoted by said rocker means.

3. The invention described in claim 2 wherein said force means comprises:

(a) counterweight means; and (b) a cable and pulley system connecting said counterweight means to said rocker means.

* * * * *

UNITED STATES PATENT AND TRADEMARK OFFICE

CERTIFICATE OF CORRECTION

PATENT NO. : 4,127,381

DATED : November 28, 1978

INVENTOR(S) : Erich Wiemer

It is certified that error appears in the above-identified patent and that said Letters Patent are hereby corrected as shown below:

On the face of the Patent, please change the name of the Assignee, Koppers Company, Inc., Pittsburgh, Pa. to Krupp-Koppers GmbH, Essen, Fed. Rep. of Germany.

Signed and Sealed this

*Tenth* Day of *July 1979*

[SEAL]

*Attest:*

*Attesting Officer*

LUTRELLE F. PARKER

*Acting Commissioner of Patents and Trademarks*